US009702224B2

(12) United States Patent
Maxwell

(10) Patent No.: US 9,702,224 B2
(45) Date of Patent: Jul. 11, 2017

(54) WELL APPARATUS AND METHOD FOR USE IN GAS PRODUCTION

(71) Applicant: Venture Engineering Services Limited, Aberdeenshire (GB)

(72) Inventor: Douglas Maxwell, Aberdeenshire (GB)

(73) Assignee: Venture Engineering Services Limited, Aberdeenshire (GB)

( * ) Notice: Subject to any disclaimer, the term of this patent is extended or adjusted under 35 U.S.C. 154(b) by 0 days.

(21) Appl. No.: 15/023,808

(22) PCT Filed: Sep. 17, 2014

(86) PCT No.: PCT/GB2014/052830
§ 371 (c)(1),
(2) Date: Mar. 22, 2016

(87) PCT Pub. No.: WO2015/044641
PCT Pub. Date: Apr. 2, 2015

(65) Prior Publication Data

US 2016/0237787 A1 Aug. 18, 2016

(30) Foreign Application Priority Data

Sep. 25, 2013 (GB) ..... 1317039.4

(51) Int. Cl.

| | |
|---|---|
| ***E21B 37/00*** | (2006.01) |
| ***E21B 37/06*** | (2006.01) |
| ***E21B 17/10*** | (2006.01) |
| ***E21B 34/06*** | (2006.01) |
| ***E21B 41/00*** | (2006.01) |
| ***E21B 43/12*** | (2006.01) |

(52) U.S. Cl.
CPC ..... *E21B 37/00* (2013.01); *E21B 17/1078* (2013.01); *E21B 34/06* (2013.01); *E21B 37/06* (2013.01); *E21B 41/0078* (2013.01); *E21B 43/121* (2013.01)

(58) Field of Classification Search
CPC ..... E21B 37/00; E21B 17/1078; E21B 34/06; E21B 37/06; E21B 41/0078; E21B 43/121
See application file for complete search history.

(56) References Cited

U.S. PATENT DOCUMENTS

| | | | |
|---|---|---|---|
| 4,250,961 | A | 2/1981 | Morse et al. |
| 4,344,488 | A | 8/1982 | Marks |
| 4,782,896 | A | 11/1988 | Witten |
| 4,921,044 | A | 5/1990 | Cooksey |
| 5,337,819 | A | 8/1994 | Tailby |
| 5,718,289 | A | 2/1998 | Schnatzmeyer et al. |
| 2006/0254765 | A1 | 11/2006 | Pfeiffer et al. |
| 2007/0246426 | A1 | 10/2007 | Collins |

(Continued)

FOREIGN PATENT DOCUMENTS

| | | |
|---|---|---|
| EP | 0229434 | 7/1987 |

*Primary Examiner* — Yong-Suk (Philip) Ro
(74) *Attorney, Agent, or Firm* — Carmody Torrance Sandak & Hennessey LLP

(57) ABSTRACT

A lower completion has a perforated region for the extraction of gas and a humidifying fin including a plurality of nozzles for injecting water droplets into the annulus surrounding the lower completion. Water droplets are mixed with the gas in the annulus surrounding the lower completion to reduce halite deposition by preventing dehydration of water within the wellbore and nearby gas reservoir.

18 Claims, 4 Drawing Sheets

(56) References Cited

U.S. PATENT DOCUMENTS

| | | | | |
|---|---|---|---|---|
| 2009/0294123 | A1 | 12/2009 | Mescall et al. | |
| 2010/0300684 | A1 | 12/2010 | Kotsonis et al. | |
| 2011/0079398 | A1 | 4/2011 | Patel et al. | |
| 2013/0048303 | A1 | 2/2013 | Patel et al. | |
| 2015/0233215 | A1* | 8/2015 | Yeh | E21B 43/045 166/278 |

* cited by examiner

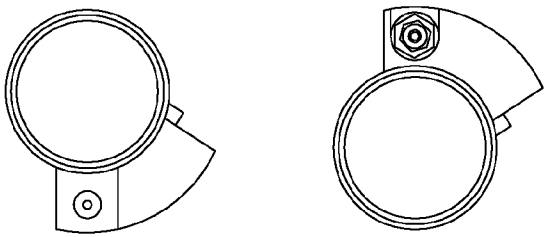
FIG. 3c
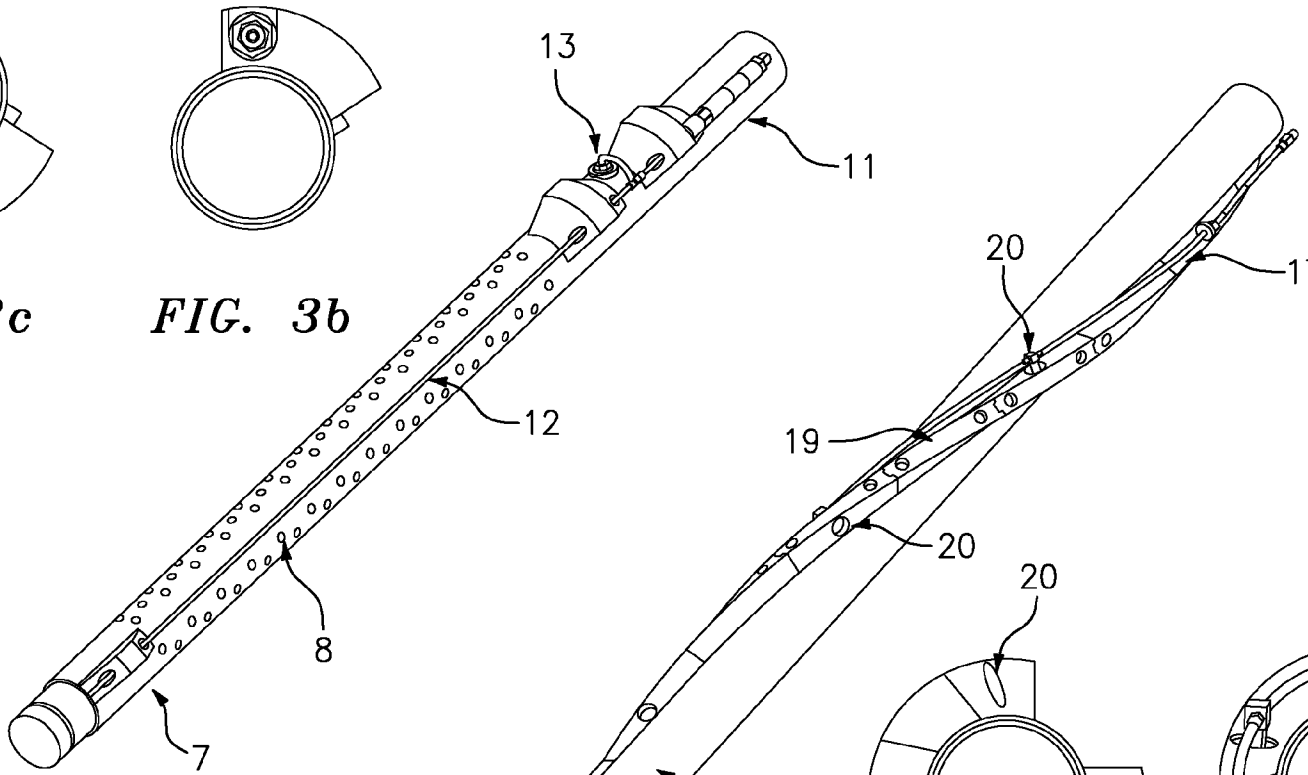
FIG. 3b
FIG. 3a
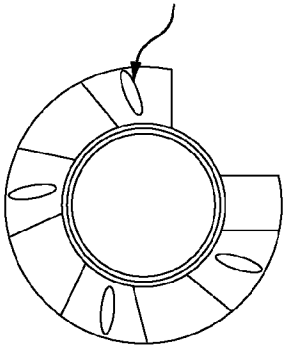
FIG. 3d
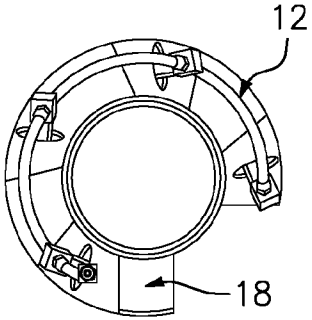
FIG. 3f
FIG. 3e

WELL APPARATUS AND METHOD FOR USE IN GAS PRODUCTION

CROSS REFERENCE TO RELATED APPLICATIONS

This application is a National Stage of International Application No. PCT/GB2014/052830 filed Sep. 17, 2014, which claims priority to Great Britain Application GB1317039.4, filed Sep. 25, 2013, the disclosures of the above applications are incorporated herein by reference.

FIELD OF THE INVENTION

The present invention relates to well apparatus and a method for use in gas production from underground reservoirs. Particularly, but not exclusively, the present invention relates to a lower completion component for use as part of a downhole tool assembly.

BACKGROUND AND BACKGROUND ART

Wells used in the production of gas, may also produce quantities of water and gas condensate. Some of these gas wells are affected by halite scale, which deposits on wellbore tubulars and may also deposit within the reservoir rock near the wellbore. This halite scale has the potential to restrict gas flow and may cause a complete blockage of the well in extreme conditions.

It is generally believed that the predominant mechanism for this halite scale deposition is the de-hydration of highly saline formation waters by natural gas as the gas flows into the near wellbore region or the well itself. If the water that lies below or within the gas reservoir is highly saline, it may take only a small amount of de-hydration to take the water past salt saturation, resulting in halite being precipitated out of solution. De-hydration occurs because, as gas expands (as it does when it flows from a high pressure reservoir into a low pressure well), its capacity to hold water increases. One way that has been used in the past to prevent the salt dropping out is to introduce fresh (or low salinity) water to the well. This fresh water dilutes the brine so that any water evaporation maintains the brine in an under saturated state.

The majority of existing systems in the oil and gas industry for delivering fresh water to a well either are deployed above the production packer via a chemical injection valve or are retrofitted to an existing well completion design by inserting an additional capillary line to a given depth inside the well tubulars where water is then injected through a single opening.

However, there are scenarios where these existing systems do not perform well:

- in deviated wells, the water injected may flow along the low side of the well only, thus keeping only a part of the well clear of halite;
- where formation water production is not well defined, risking over injection of water, leading to the accumulation of liquid water in the wellbore, resulting in increased hydrostatic head and the loss of well production;
- where gas inflow locations are not well defined and the injection point (or points) do not cover the inflow zones;
- where only small amounts of formation water are produced and is immediately evaporated on entry into the wellbore, thus precipitating halite before the gas encounters the injected water;

- where only small amounts of formation water are produced and are evaporated prior to entry into the wellbore, thus precipitating halite in the near wellbore region of the well;
- in a combination of the above scenarios.

Furthermore, water in a liquid form may have a significant residence time in the well (in the form of travel time up the wellbore) before being evaporated by the natural gas. This can lead to significant deposition at the bottom of the well.

SUMMARY OF THE INVENTION

The present invention seeks to address these and other problems arising from halite deposition during gas production.

The present invention also seeks to provide an apparatus and method for reducing halite deposition during gas production.

The present invention further seeks to provide an apparatus and method for delivering water having a lower salinity than the salinity of formation water present in the gas reservoir to one or more gas inflow sites in a well during gas production.

The present invention further seeks to provide an apparatus and method for delivering low salinity water in a manner that dilutes the saline formation water and promotes the uptake of the introduced low salinity water by the gas on expansion in preference to the saline formation water.

The present invention therefore provides well apparatus for use in gas production, the well apparatus comprising a production tubing having a gas inlet; a water distribution pipe disposed on the production tubing; and a plurality of separate nozzles in fluid communication with the water distribution pipe wherein the plurality of nozzles are adapted to inject fine water droplets around the exterior of the production tubing and the plurality of nozzles are spatially distributed axially and circumferentially on the production tubing.

Preferably the well apparatus further comprises a fin extending radially outwardly from the production tubing and wherein the plurality of nozzles is mounted on the fin.

Ideally, the fin describes a helical path around the production tubing. Also, the nozzles may be arranged such that water is injected by the nozzles substantially tangentially to the circumference of the production tubing.

In a particularly preferred embodiment the fin has first and second substantially parallel side walls and the water distribution pipe is mounted on the upwardly facing side wall of the fin. More preferably the plurality of nozzles is arranged such that their nozzle outlets are in the side wall of the fin that has the greater intimate contact with the gas flow. Ideally the nozzle outlets project through the downwardly facing side wall of the fin.

Preferably the fin and the accompanying plurality of nozzles extend at least 180° around the production tubing, more preferably at least 270°.

The well apparatus may further comprise at least one upper nozzle in fluid communication with the water distribution pipe, the at least one upper nozzle being adapted to inject water into the interior of the production tubing. Also, the well apparatus may additionally include a valve in fluid communication with the water distribution pipe for controlling the supply of water to the plurality of nozzles.

Ideally, the plurality of nozzles is adapted to generate a substantially atomized mist of water particles.

In a particularly preferred embodiment, the plurality of nozzles is disposed below the gas inlet. Also one or more of the plurality of nozzles may be disposed adjacent the gas inlet.

The gas inlet may comprise a perforated region of the production tubing or may comprise a ceramic sand screen. Also the perforated region may be above and separate from the region of the production tubing on which the fin is mounted.

In a separate aspect the present invention further provides a method of limiting halite deposition in a well during gas production, the method comprising positioning a production tubing in a gas reservoir and injecting water into the region surrounding the production tubing during gas production, wherein the water is injected into the region surrounding the production tubing using a plurality of nozzles in fluid communication with a water distribution line, the plurality of nozzles being spatially distributed axially and circumferentially on the production tubing.

The present invention is preferably a lower completion component that may be stand alone, part of a system or modified to form a system for use in gas producing wells. Thus the present invention is a water distribution component adapted to function as a gas reservoir humidifier. Moreover, in use, the present invention is adapted to deliver low salinity water to an area of gas production so as to control salt deposition in the gas well.

In contrast to existing systems, the present invention produces fine water droplets, preferably substantially atomised water particles, at or near the wellbore which are easily evaporated by the gas as the gas expands.

Furthermore, this fine mist of water injected at or near the wellbore is much less likely to reside at the bottom of the well, and any excess is easily extracted to the surface.

It is to be understood that reference herein to 'lower' and 'below' is intended as reference to components and features of the apparatus that are deeper in the well relative to 'upper' components and features that are 'above' and consequently closer to the entrance to the well (wellhead). Similarly reference herein to 'downwardly facing' is reference to a component facing approximately away from the wellhead, whereas reference herein to 'upwardly facing' is reference to a component facing approximately towards the wellhead.

BRIEF DESCRIPTION OF THE DRAWINGS

Embodiments of the present invention will now be described by way of example only with reference to the accompanying drawings, in which:

FIG. 3*a* is a perspective view of the upper section of the reservoir humidifier tool of FIG. 1 without centralisers;

FIGS. 3*b* and 3*c* are plan views from opposing ends of the upper section of the reservoir humidifier tool of FIG. 3*a;*

FIG. 3*d* is a perspective view of the lower section of a reservoir humidifier tool of FIG. 1 without centralisers;

FIGS. 3*e* and 3*f* illustrate respectively the inner surface of the side wall of the humidifier fin and the outer surface of the side wall of the humidifier fin of the lower section of the reservoir humidifier tool of FIG. 3*d;*

DETAILED DESCRIPTION OF AN EXEMPLARY EMBODIMENT

Figure 1:
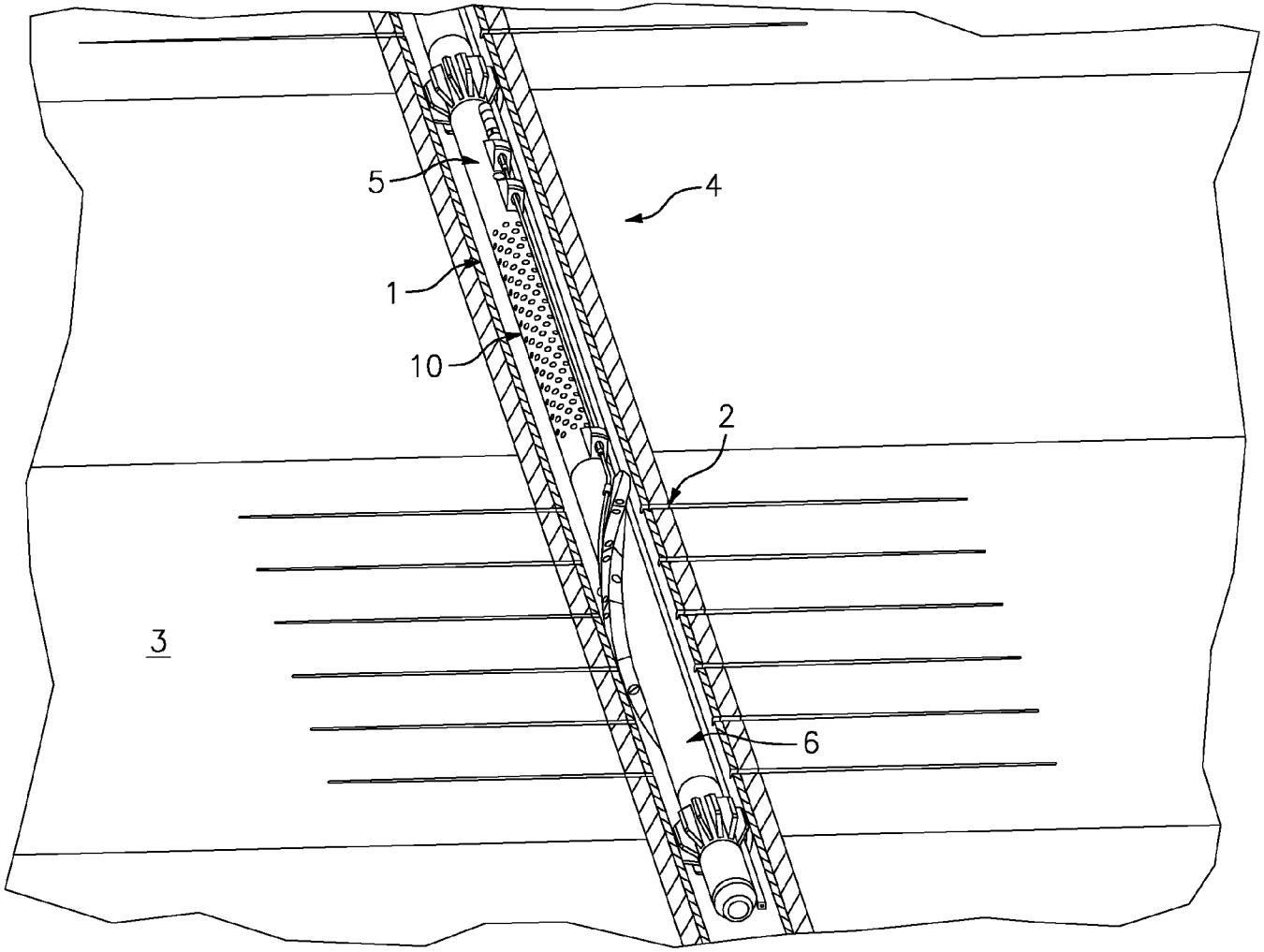
FIG. 1 illustrates a humidifier tool according to the present invention set opposite cased hole perforations in a downhole tool assembly.

In FIG. 1 a wellbore casing 1 is shown with a plurality of perforations 2 providing fluid communication between the interior of the wellbore casing 1 and an underground gas reservoir 3. Positioned within the wellbore casing 1 is an apparatus for use in extracting gas from the gas reservoir 3. The apparatus is a lower completion component 4 which will be referred to herein as a reservoir humidifier tool. In overview, the reservoir humidifier tool 4 comprises an upper section 5 and a lower section 6 each of which will be described in greater detail below with reference to FIGS. 3*a* to 3*f* and FIGS. 4*a* to 4*g*. The upper and lower sections 5, 6 of the reservoir humidifier tool may be manufactured as a single unitary component or as two separate interconnecting components. In the latter case, interconnection of the upper and lower sections is achieved using any conventional means for example, but not limited to, a threaded coupling.

The metallurgy of the two sections 5, 6 is selected in dependence upon expected downhole conditions. Several factors may contribute to the selection of the material for the base pipe including, but not limited to: gas composition; temperature; pressure; the expected longevity or lifetime of the completion; and, whether the water to be injected by the reservoir humidifier tool is to de de-oxygenated. In some environments L80 carbon steel may be appropriate, but if high chlorides and $CO_2$ are likely to be present then L80 carbon steel with 13% chrome or possibly 28% chrome with a high nickel content may be used instead. Similarly, for other expected downhole environments materials different to those mentioned above may be used for the upper and lower sections 5, 6.

The base pipe 7 of the upper section 5 of the reservoir humidifier tool includes a perforated region 8. The perforated region 8 has a plurality of pre-drilled holes 9 extending through the thickness of the pipe 7 to allow gas flow from the annulus 10 of the casing 1 to the inside of the tool. The drilled holes 9 are arranged in an array along the length and circumference of the perforated region 8 with the axial length of the perforated region 8 and the cumulative open flow area of the holes being determined with respect to expected gas flow rates, the spatial distribution of the perforations being determined so as to minimize loss of base pipe tensile strength. The array of drilled holes 9 need not be continuous. For example, within the perforated region 8, one or more axially extending un-perforated channels may be provided where capillary lines run to minimise erosive damage.

The upper section 5 further includes an injection valve 11 mounted in a housing on the exterior of the base pipe 7. The injection valve 11 is preferably conventional in design and is used to control the release of water by the reservoir humidifier tool. A detailed description of a conventional injection valve may be found in WO2011/043872 the total content of which is incorporated herein by reference. The injection valve 11 is in liquid communication with a water distribution pipe in the form of an encapsulated capillary line 12 which delivers water to the injection valve 11 and beyond (see below). The capillary line 12, and all other tool fittings, is preferably, but not exclusively, made of ¼" or ⅜" (6.35 mm or 9.53 mm) SS316L stainless steel but alternative sizing or metallurgy may be selected subject to the expected downhole conditions and pressure drops expected. For example, for harsher environments, for the pipe and all other tool fittings, Duplex 2205, Super Duplex 2507, an Inconel alloy 625 or even Hastelloy C-275 may be used instead.

Adjacent the injection valve 11 an upper nozzle 13 is provided which is in fluid communication with and downstream of the injection valve 11. The upper nozzle 13 is either mounted on the interior wall of the base pipe 7 or projects through an aperture in the base pipe 7 into the interior of the base pipe 7. In both cases the upper nozzle 13 is arranged to deliver fine water droplets, preferably an atomised water mist, to the gas flow path in the interior of the base pipe 7. The upper nozzle 13 comprises an impingement or impellar type jet made, for example, of tungsten carbide or a similar wear resistant material. The size of the nozzle orifice or outlet is selected in dependence on the desired flow rate and pressure of the water achievable by the tool. In the majority of cases the nozzle outlet is expected to be in the range 0.01-0.02 mm diameter and this accommodates total system flow rates in the range 0.1 to 2 liters per minute (divided by the total number of nozzles supplied by the capillary line 12. Nozzle pressures in the range 100-250 psi are preferable but lower pressure nozzles may alternatively be necessary where surface application pressure is limited. The nozzle 13 (and any one or more of the lower nozzles described below) may be poppet mounted, allowing the nozzle to be by-passed should higher water flow rates be required (for tubing flush or formation soak) by increasing injection pressure past the poppet threshold.

To ensure alignment of the upper section 5 in the wellbore casing 1 (or in the absence of a casing) within the well, and to provide physical protection to the tool during installation in the well, an upper finned centraliser 14 is provided at the upper end of the upper section 5. The centraliser 14 includes a plurality of radially outwardly extending fins with outer abutment surfaces for contact with the inner surface of the wellbore casing 1 or the wall of the well so as to ensure proper centralised alignment of the wellbore. Sufficient clearance is provided in order for the tool to fit within the well architecture, as per standard oilfield practice. Axially extending channels are formed between pairs of adjacent fins to allow axial passage of capillary lines 12 and any capillary line splices. This passage may be modified to provide clamping facility in order to secure the capillary lines in place. The centraliser 14, which is preferably conventional in design, may be a separate sleeve type component that slips on over the base pipe 7. Alternatively the centraliser 14 may be welded to or machined from the base pipe 7. In some instances, the centralizer may be replaced or enhanced by an annulus isolation packer in order to provide zonal isolation. This packer may have hydraulic feedthroughs in order to allow the passage of the water supply to the lower tools. In a further alternative, a swell type packer may be utilized.

The lower section 6 of the reservoir humidifier tool includes a base pipe 15 which is axially aligned with, and optionally integrally formed with, the base pipe 7 of the upper section 5. The metallurgy of the lower section's base pipe 15 is dependent upon the expected downhole environment.

The lower section 6 preferably includes a centraliser 16 which is identical or very similar to the centraliser 14 of the upper section 5. The lower centraliser 16 is mounted at the lowermost end of the lower section 6 and so, in combination with the upper centraliser 14, ensures the lower completion remains axially aligned and centralised within the well.

Provided on the outside of the base pipe 15 of the lower section 6 is one or more radially outwardly extending humidifier fins 17 (one fin is shown in the figures). The at least one fin 17 is positioned so as to be substantially aligned with the apertures in the wellbore casing. The humidifier fin 17 follows a helical path around the outside of the base pipe 15 and thereby encourages a corresponding helical gas flow around the outside of the base pipe 15. In the particular embodiment illustrated in the drawings, the humidifier fin 17 extends approx. 350° around the base pipe 15. This leaves a straight line path from adjacent the injection valve 11 to the next tool. This ensures the humidifier fin 17 is not a barrier to the passage of a subsequent supply line to a lower tool.

The humidifier fin 17 is substantially solid with the exterior surfaces of the fin 17 consisting of a pair of substantially parallel continuous side walls 18 that extend outwardly substantially orthogonal to the outer surface of the base pipe 15 and an upper wall 19 which bridges the radially outermost edges of the two side walls 18. The capillary line 12 is mounted to one of the side walls 18 which provides physical protection to the capillary line 12 while being run in hole and provides protection to the capillary line 12 from erosional damage during gas production. In the illustrated embodiment the capillary line 12 is mounted to the upwardly facing side wall 18 of the fin 17. In an alternative embodiment the fin 17 may be hollow and adapted to accommodate the capillary line 12 within it. The humidifier fin 17 may be bolted, welded or machined to the base pipe 15 and may be formed of the same material as the base pipe or of a different material that is unreactive with the downhole environment e.g. a metallic material, silicon-based material, rubberised material or Teflon™-type material.

A plurality of lower nozzles 20 are mounted within the humidifier fin 17 and so are arranged to direct fine water droplets, preferably an atomised water mist, laterally (i.e. tangentially to the circumference of the base pipe 15) directly into the path of the gas flow. The lower nozzles 20 are separated from one another, preferably at regular intervals, another along the length of the fin 17. The nozzles 20 may be positioned so as to be substantially aligned with the apertures in the wellbore casing. The plurality of nozzles 20 preferably extend at least 180° around the base pipe 15 and more preferably 270°.

In a particularly preferred embodiment the plurality of lower nozzles 20 are mounted in the fin 17 with their nozzle outlets all facing substantially in the same direction. In this embodiment the nozzle outlets are located in apertures in the side wall 18 on the side of the helix that has greater intimate contact with the gas flow around the outside of the base pipe 15. Usually, as the gas flows substantially upwards the downwardly facing wall of the fin (the side facing the outside of the helix) will have greatest intimate contact with the high pressure high flow rate stream whereas the upwardly facing wall of the fin (the side facing the inside of the helix) will be in a lower pressure, lower flow rate zone. So, usually the nozzle outlets will be in the side wall facing towards the gas flow from above, i.e. the downwardly facing side wall 18.

In addition to providing a physical support to the lower nozzles 20, the humidifier fin 17 causes the gas to flow past the lower nozzle outlets thereby maximising water droplet and gas mixing. Each lower nozzle 20 is the same as or similar to the upper nozzle 13 and each is connected to the capillary line 12 by means of a T-junction. Thus the injection valve 11 controls the supply of water to, and the one capillary line 12 delivers water to, a plurality of nozzles 13, 20 which are distributed axially and circumferentially around the lower completion. The angle of the helix described by the humidifier fin 17 is sufficiently shallow to ensure the lower nozzles are well distributed across the lower section 6 whilst minimising high fluid pressure losses that can arise from such a convoluted flow path. The lowermost lower nozzle 21 also constitutes termination of the capillary line 12.

Above the upper centraliser 14, a conventional tool box 22 (not shown) is provided for connection to a second reservoir humidifier tool or to production tubing. Below the lower centraliser 16 a conventional tool pin 23 (not shown) is provided for connection to a further reservoir humidifier tool, to other tools or to a bullnose end cap. The design and functionality of the tool box 22 and the tool pin 23 are subject to conventional pipe size and connectivity requirements.

Figure 2:
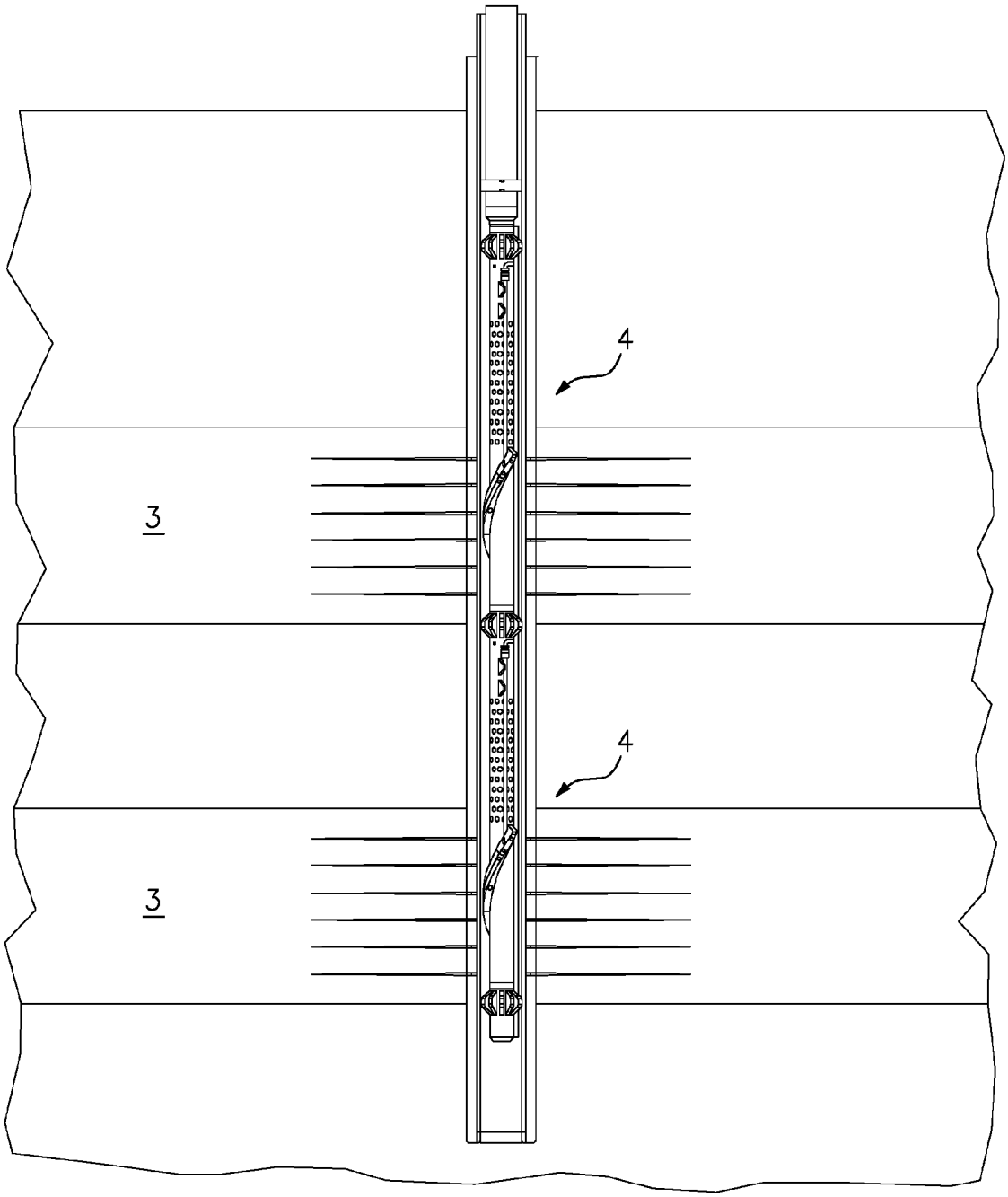
FIG. 2 illustrates a pair of humidifier tools according to the present invention in a downhole tool assembly extending across two producing intervals.
Figure 4A:
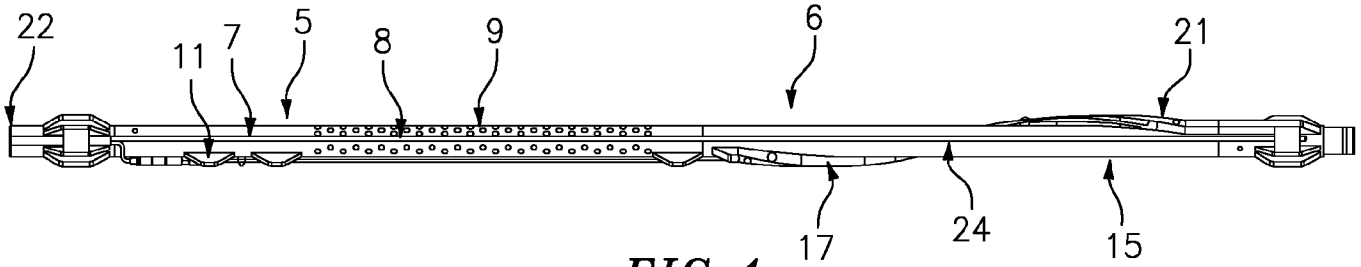
FIGS. 4*a* through 4*c* are plan views at different rotational positions of the reservoir humidifier tool of FIG. 1 with centralisers.
Figure 4B:
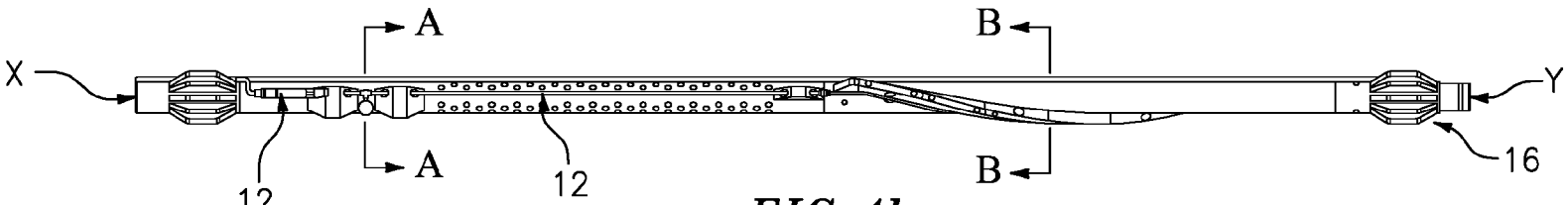
Figure 4E:
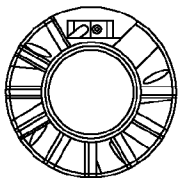
FIGS. 4*d* and 4*e* are plan views (enlarged using a scale of 1:3) inwardly from ends X and Y respectively.
Figure 4G:
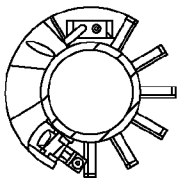
FIGS. 4*f* and 4*g* are cross-sectional views (enlarged using a scale of 1:3) taken through sections A-A and B-B respectively.
Figure 4F:
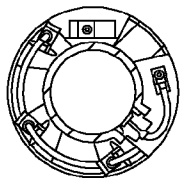
Figure 4D:
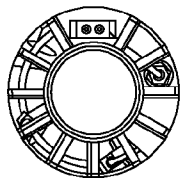
Figure 4C:
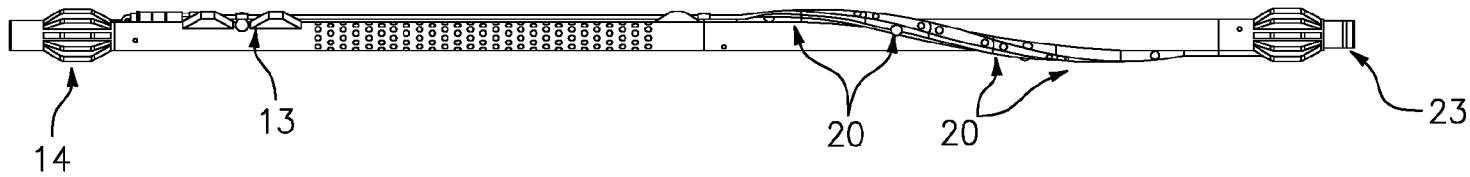

The above description describes a single reservoir humidifier tool 4. It will, of course, be understood that for larger gas production intervals a plurality of reservoir humidifier tools may be connected together, end to end, so as to ensure humidification for a major part, if not all, of the production interval. Similarly, as illustrated in FIG. 2, where a plurality of gas production intervals exist separate by non-productive regions, the lower completion may include a plurality of reservoir humidifier tools 4 connected together, end to end, or connected with intervening production tubing so that each reservoir humidifier tool is aligned with a gas production interval. Where a plurality of humidifier tools are used in a lower completion, the capillary lines for the lower humidifier tools follow a straight line path (substantially parallel with the axis of the tools) defined between opposing ends of the humidifier fin(s) on tools higher up in the lower completion. Although not illustrated in the figures, it is envisaged that a reservoir humidifier mandrel may have a plurality of capillary lines each supplying water to a different plurality of nozzles.

The lower section 6 of the humidifier tool 4 has an un-perforated base pipe 15 with a tight tolerance with respect to the wellbore casing. This prevents significant gas expansion at the point of entry to the wellbore, moving the point of major gas expansion to the pre-drilled perforations in the upper section 5 near the top of the mandrel, by which time the atomized water particles are already entrained in the stream of gas.

Although reference has been made herein to a wellbore casing 1, it is to be understood that for certain underground gas extraction environments the casing may be omitted.

In use, the humidifier tool 4 is run into the well below an upper completion (usually consisting of production tubulars, a safety valve and a production packer). If a suitable wet connector to allow the connection of the capillary pipe downhole exists, the lower completion assembly, including one or more reservoir humidifier tools and tubing for spaceout plus some form of hanger system, may be run into the well first and separate from the upper completion. Otherwise the lower completion, with the one or more reservoir humidifier tools 4, will be run as a tailpipe to the upper completion (i.e. below the production packer). In a cased hole well, perforation operations would need to be performed prior to running the completion. It may therefore be necessary to place a loss control pill in the cased hole prior to running the completion.

It is further envisaged that, in use, injection of an atomised water mist may be maintained for a period during well shut-in. This would enable re-saturation of the reservoir, thus re-dissolving precipitated salt crystals in the near wellbore region. It would also prevent salt deposition resulting from crossflow between productive intervals at different pressures.

The reservoir humidifier tool or mandrel described above can be built as a single completion component for a range of cased hole sizes. The reservoir humidifier mandrels may be stock components or may be manufactured/adapted on demand. As mentioned earlier, it can be stacked (with or without spacers) with other reservoir humidifier mandrels to cover a longer interval, although the number of mandrels will be limited by the number of capillary lines available (up to 8 is the maximum currently anticipated).

There are a number of optional modifications to the reservoir humidifier mandrel that can be applied to make it suitable for varying downhole well configurations. Where the gas production zone is of a significantly larger length than can be covered by the maximum number of reservoir humidifier mandrels that can be run (limited by the maximum number of capillary lines), an extension mandrel can be added to the bottom of the tool and the nozzles spaced out across the two mandrels. This extension mandrel may have the same spiral flow control as a single reservoir humidifier mandrel. Where an extension mandrel is used, the total number of nozzles will depend on the pressure and flowrate available from surface. If a larger number of nozzles are required, only a sub-group of the total number of nozzles (e.g. the top two) will be poppet type because it is unlikely sufficient pressure can be generated to open large numbers of nozzles.

Isolation packers may replace or supplement the centralisers in order to reduce the amount of annular flow in any one section or to allow for individual zone isolation.

The apparatus and method described above can be used in open hole, either with or without isolation packers. Where sand control is required, the pre-drilled perforations may be replaced with a ceramic sand screen. Where gas flow control is required, the pre-drilled perforations can be replaced with a conventional sliding sleeve porting system. Where both sand control and gas flow control is required, a combined sliding sleeve and ceramic sand screen system may be employed.

Where a larger inflow area is required (for example for sand control in a very weak sandstone) the nozzles may be distributed via a modified cross-coupling protector. In this case, the spiral flow control may not be applied, nor the phasing of the nozzles, as the advantage will be lost over the longer lengths.

Although not mentioned earlier, data gathering sensors may be deployed with this apparatus including, but not limited to, fibre optic DTS (Distributed Temperature Sensing) and discrete electrical sensors for pressure, temperature and flow.

It is to be understood that features of the humidifier fin 17 described above may be altered without substantially departing from its intended functionality. For example, as mentioned above the fin may be hollow; the side walls of the fin may be substantially planar (as illustrated) or may have discontinuities in the form of sharp changes in the generally helical direction; the side walls need not be substantially parallel with one another and may individually be positioned at a non-zero acute angle to the radial direction of the wellbore. Furthermore, the fin 17 may have nozzle outlets projecting from both side walls so as to inject water droplets into the helical gas flow both from below and from above. Also, the humidifier fin may be formed of a plurality of separate fin components spaced apart from one another but arranged so as to collectively describe a helical path around the base pipe. With this arrangement the helical path of the fin and the accompanying nozzles may extend more than 360° around the base pipe but with the some of the spaces between adjacent fin components axially aligned so as to provide a linear path for capillary lines to lower tools.

Features of the other components of the well apparatus described above may similarly be altered without substantially departing from their intended functionality.

Alternative and additional adaptations and modifications to the specific embodiments described herein are, of course, envisaged without departing from the scope of the present invention defined by the accompanying claims.

The invention claimed is:

1. Well apparatus for use in gas production, the well apparatus comprising a production tubing having a gas inlet, a circumference and an exterior surface; a water distribution pipe disposed on the production tubing; a fin extending substantially radially outwardly from the production tubing; and a plurality of water droplet nozzles in fluid communication with the water distribution pipe wherein the plurality of water droplet nozzles are mounted on or in the fin and are adapted to inject fine water droplets into a region around the exterior surface of the production tubing, the water droplet nozzles of the plurality of water droplet nozzles being spatially distributed axially and circumferentially on the production tubing.

2. The well apparatus as claimed in claim 1, wherein the fin describes a helical path around the production tubing.

3. The well apparatus as claimed in claim 1, wherein the fin describes a helical path around the production tubing, the helical path of the fin extending less than 360° around the production tubing.

4. The well apparatus as claimed in claim 1, wherein the plurality of water droplet nozzles are adapted to inject the fine water droplets into the region substantially tangentially to the circumference of the production tubing.

5. The well apparatus as claimed in claim 1, wherein the plurality of water droplet nozzles are arranged to inject fine water droplets outwardly from a side of the fin that has greater intimate contact with a gas flow towards the gas inlet.

6. The well apparatus as claimed in claim 5, wherein the plurality of water droplet nozzles are arranged to inject fine water droplets outwardly from a side wall of the fin facing away from a top of the well.

7. The well apparatus as claimed in claim 1, further comprising at least one upper nozzle in fluid communication with the water distribution pipe, the at least one upper nozzle being adapted to inject water into an interior of the production tubing.

8. The well apparatus as claimed in claim 1, further comprising a valve in fluid communication with the water distribution pipe for controlling a supply of water to the plurality of water droplet nozzles.

9. The well apparatus as claimed in claim 1, wherein the plurality of water droplet nozzles is adapted to generate fine water droplets in the form of a substantially atomized mist of water particles.

10. The well apparatus as claimed in claim 1, wherein the plurality of water droplet nozzles are disposed below the gas inlet.

11. The well apparatus as claimed in claim 10, wherein one or more of the plurality of water droplet nozzles are disposed adjacent the gas inlet.

12. The well apparatus as claimed in claim 1, wherein the gas inlet comprises a perforated region of the production tubing.

13. The well apparatus as claimed in claim 1, wherein the gas inlet comprises a ceramic sand screen.

14. The well apparatus as claimed in claim 12, wherein the perforated region is above and separate from a region of the production tubing on which the fin is mounted.

15. The well apparatus as claimed in claim 1, further comprising couplings at opposing ends of the production tubing for connection with further production tubing.

16. The well apparatus as claimed in claim 1, wherein the production tubing is a lower completion for a downhole tool assembly with the water droplet nozzles of the plurality of water droplet nozzles spatially distributed axially and circumferentially around the lower completion.

17. A method of limiting halite deposition in a well during gas production using a production tubing having a circumference, an exterior surface and a fin extending substantially radially outwardly from the production tubing, the method comprising positioning a production tubing in a gas reservoir and injecting fine water droplets into a region surrounding the exterior surface of the production tubing during gas production, wherein the fine water droplets are injected into the region surrounding the exterior surface of the production tubing using a plurality of water droplet nozzles in fluid communication with a water distribution line, the plurality of water droplet nozzles being mounted on or in the fin and spatially distributed axially and circumferentially on the production tubing.

18. The method as claimed in claim 17 wherein the production tubing is a lower completion for a downhole tool assembly with the water droplet nozzles of the plurality of water droplet nozzles spatially distributed axially and circumferentially around the lower completion component.

* * * * *